United States Patent [19]

Dobner

[11] Patent Number: 4,691,901

[45] Date of Patent: Sep. 8, 1987

[54] GAS RINSING STOPPER PREVENTING MIXING OF AIR WITH RINSING GAS

[75] Inventor: Gerd-Erich Dobner, Neukirchen-Vluyn, Fed. Rep. of Germany

[73] Assignee: Didier-Werke Ag, Wiesbaden, Fed. Rep. of Germany

[21] Appl. No.: 942,627

[22] Filed: Dec. 16, 1986

[30] Foreign Application Priority Data

Dec. 21, 1985 [DE] Fed. Rep. of Germany ..... 3545763

[51] Int. Cl.[4] ..... B22D 41/10; B22D 11/10

[52] U.S. Cl. ..... 266/236; 164/337; 164/415; 266/271

[58] Field of Search ..... 164/337, 415; 222/598, 222/602, 603; 266/271, 236, 220, 225, 226

[56] References Cited

U.S. PATENT DOCUMENTS 3,200,457 8/1965 Wagstaff ..... 164/337 X
3,214,804 11/1965 Saccomano ..... 266/236 X
3,565,412 2/1971 Moniot ..... 266/225
3,964,535 6/1976 Bedell et al. ..... 164/415 X
4,064,925 12/1977 Fastner et al. ..... 266/236 X

*Primary Examiner*—J. Reed Batten, Jr.
*Attorney, Agent, or Firm*—Wenderoth, Lind & Ponack

[57] ABSTRACT

A gas rinsing stopper includes a stopper member having therethrough an axial gas passage, a mounting fixture extending into a first end of the gas passage, a gas feed opening at a second end of the passage, and a gas supply line extending into the gas passage. A seal member is positioned within the gas passage and forms a gas tight seal separating the gas passage into a first section including the mounting fixture and a second section leading to the gas feed opening. The gas supply line opens into the second section of the gas passage, such that rinsing gas supplied through the gas supply line is isolated from the first section of the gas passage. This prevents the supply of rinsing gas from creating a reduced pressure at the first end of the gas passage, and thereby prevents atmospheric air from being drawn into the gas passage and mixing with the rinsing gas.

9 Claims, 2 Drawing Figures

GAS RINSING STOPPER PREVENTING MIXING OF AIR WITH RINSING GAS

BACKGROUND OF THE INVENTION

The present invention relates to a stopper for use with a metallurgical vessel containing molten metal, and specifically to such a stopper of the type wherein a gas, normally an inert gas, is suppled through the stopper for rinsing, flushing or scavenging purposes, as well as for other purposes which would be apparent to one skilled in the art. More particularly, the present invention is directed to such a gas rinsing stopper including a stopper member having therethrough an axial gas passage, a mounting fixture extending into a first end of the gas passage and connected to the stopper for mounting thereof, a gas feed opening at a second end of the gas passage, and a gas supply line extending into the gas passage for supplying rinsing gas thereto and thereby for discharging the rinsing gas through the gas feed opening.

A gas rinsing stopper of this type is disclosed in WO No. 82/03349. However, this known type of gas rinsing stopper is subject to an inherent disadvantage. Thus, when the rinsing gas, for example argon, is supplied to the gas passage and is discharged through the gas feed opening, this creates a reduced pressure at the end of the gas passage to which is mounted the mounting fixture. This causes atmospheric air to be drawn inwardly through this end of the gas passage, and this atmospheric oxygen blends or mixes with the rinsing gas and is discharged therewith through the gas feed opening. This results in a degradation of the quality of the particular metal involved, for example steel, possibly leading to alumina accretions at the nozzle of the metallurgical vessel to be closed by the stopper.

SUMMARY OF THE INVENTION

Accordingly, it is an object of the present invention to provide a gas rinsing stopper device of the above described general type, but constructed in a manner to prevent air from being drawn into the gas passage and mixing therein with the rinsing gas.

This object is achieved in accordance with the present invention by the provision of a seal member positioned within the gas passage and forming a gas tight seal separating the gas passage into a first section including the mounting fixture and a second section leading to the gas feed opening. The gas supply line opens into the second section of the gas passage, such that the rinsing gas is isolated from the first section of the gas passage. Since the rinsing gas is fed only to the second section of the gas passage and is isolated from the first section thereof, the feeding of the rinsing gas cannot produce a reduced pressure within the first section, and there is no tendency for air to be drawn into the gas passage. The gas supply line may end at the seal member and be sealingly connected thereto to supply the rinsing gas through the seal member into the second section, for example by means of connecting the inner end of the gas supply line to a sleeve sealingly fixed within the seal member. The gas supply line may extend axially through the mounting fixture to the seal member or may extend through the stopper member along side the mounting fixture to the seal member. Alternatively, the gas supply line may open into the second section of the gas passage at a position between the seal member and the gas feed opening, thereby by-passing the seal member. The gas passage may be formed with a step, with the seal member abutting the step and being fixed within the gas passage in a gas tight manner by a suitable mortar.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
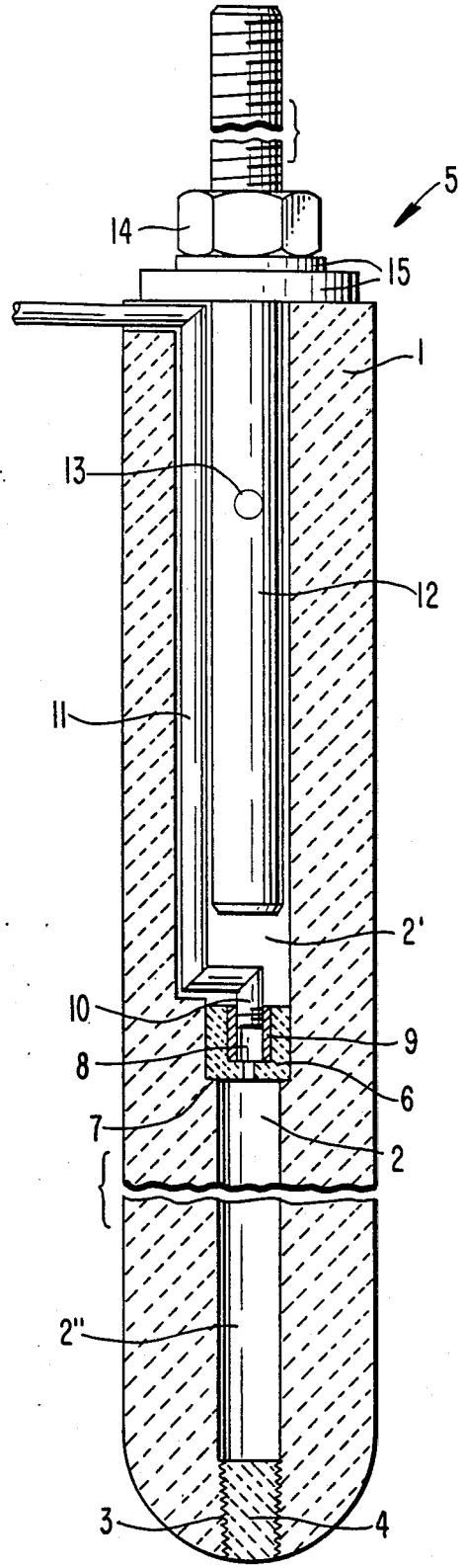
FIG. 1 is a longitudinal sectional view of a gas rinsing stopper in accordance with a first embodiment of the present invention.

As shown in FIG. 1, a gas rinsing stopper includes an elongated stopper 1 having therethrough an axial gas passage 2. A mounting fixture 5 extends into an upper end of gas passage 2 and includes a guide rod 12 projecting into the gas passage. A locating pin 13 passes through stopper 1 and guide rod 12 and is fixed by cement. A nut 14 is threaded onto guide rod 12 and presses via a pair of washers 15 on the upper end of stopper 1. The lower end of gas passage 2 includes a gas feed opening 3 which may have therein, for example, a gas permeable member 4. A rinsing gas supply line 11 supplies a suitable rinsing gas into gas passage 2 to discharge the rinsing gas through member 4 and opening 3.

The above structure is known in the art, and it is contemplated that the various elements will be formed of materials which are known and suitable for use in a particular installation, as would be understood by one skilled in the art. However, an inherent problem with this apparatus is that, upon the rinsing gas being supplied to gas passage 2 and discharged through opening 3, there is created a reduced pressure at the upper end of the gas passage adjacent mounting fixture 5, and this causes atmospheric air to be drawn inwardly through the upper end of the gas passage 2. Thereby, atmospheric oxygen mixes with the rinsing gas and is discharged therewith, thereby degrading the quality of the metal in the particular vessel with which the stopper device is employed.

In accordance with the present invention however, this disadvantage is overcome. Thus, a gas tight seal member 6 is mounted within gas passage 2 and forms a gas tight seal separating gas passage 2 into an upper section 2' including mounting fixture 5 and the upper end of the gas passage and a second section 2'' leading to gas feed opening 3. Furthermore, the gas supply line 11 opens only into second section 2'' of the gas passage, such that the rinsing gas is isolated from the first section 2'.

Specifically, seal member 6 may be mounted to abut on a step 7 formed in gas passage 2, with seal member 6 being fixed by mortar in a gas tight fashion within the gas passage. The seal member may be located, for example, at approximately the upper third of the height of the gas passage. The seal member 6 therefore separates in a gas tight manner upper section 2' from lower section 2''.

In the arrangement illustrated, seal member 6 has therethrough a gas passage 8 into which is sealingly inserted a sleeve 9 which is internally threaded. The inner end 10 of gas supply line 11 is threaded into the internal thread of sleeve 9.

In the embodiment illustrated in FIG. 1, gas supply line 11 extends through stopper 1, for example in a recess formed therein, along side and adjacent to guide rod 12 of mounting fixture 5 to a position adjacent seal member 6, and then extends into upper section 2' and is threaded into sleeve 9. By this arrangement, the rinsing gas is isolated from upper section 2' and opens only into lower section 2''. As a result, the supply of the rinsing gas cannot create a reduced pressure in upper section 2', and atmospheric air cannot be drawn through mounting fixture 5 into the gas passage.

Figure 2:
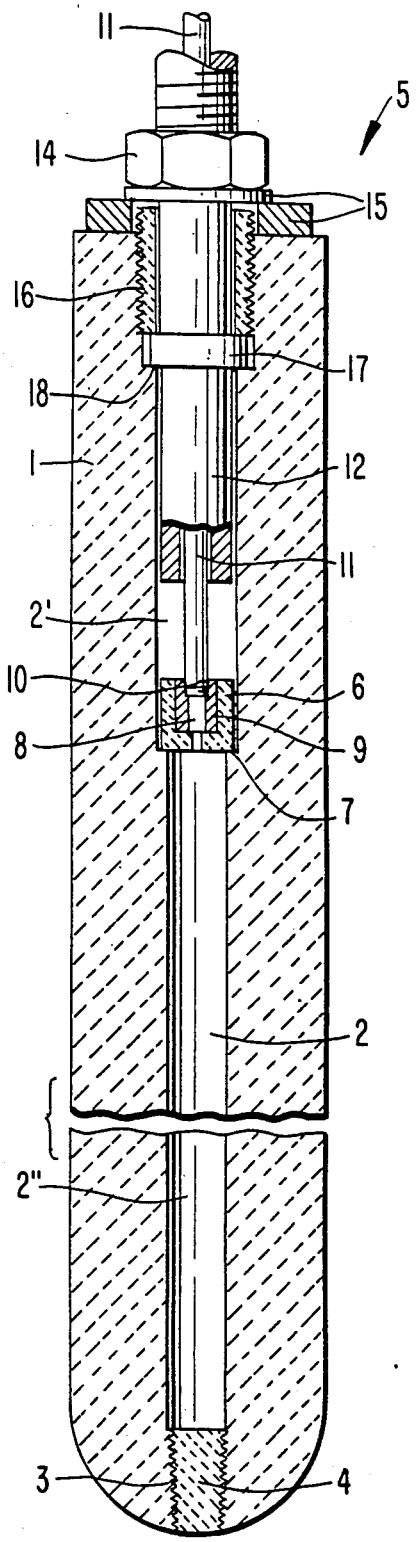
FIG. 2 is a similar view but of a second embodiment of the present invention.

FIG. 2 illustrates a somewhat modified embodiment of the present invention wherein the guide rod 12 of the mounting fixture 5 is in the form of a tubular member, with gas supply line 11 passing therethrough. This embodiment has the advantage that it is not necessary to weaken the structure of stopper 1 by the formation therein of a recess such as in the embodiment of FIG. 1. Guide rod 12 is formed with a collar 17 which abuts on an annular edge or step formed in stopper 1. An externally threaded sleeve 16 is threaded into the upper end of stopper 1 and presses collar 17 against edge or step 18. By this arrangement the mounting fixture is connected to the stopper. In other respects, The embodiment of FIG. 2 is similar to the embodiment of FIG. 1, described above.

In both of the embodiments of FIGS. 1 and 2, the seal member 6 performs, on the one hand, the function of sealing the lower section 2'' from the upper section 2' and, on the other hand, the leak-proof connection of the gas supply line 11 to the lower section 2'' of the gas passage 2. In order to achieve in a simple manner the leak-proof seating of end 10 of gas supply line 11 to the threads of sleeve 9, the mating threads on end 10 can be tapered slightly.

It is contemplated in accordance with the present invention that the seal member 6 would not have therethrough opening 8 and sleeve 9, but rather would be entirely closed and therefore form a complete barrier between upper section 2' and lower section 2''. In such arrangement, the gas supply line 11 would not be connected to seal member 6, but rather would open directly into lower section 2'' while by-passing seal member 6. Thus, the gas supply line 11 would open into second section 2'' at a position between seal member 6 and gas feed opening 3.

Although the present invention has been described and illustrated with regard to preferred features thereof, it is to be understood that various modifications and changes may be made to the specifically described and illustrated features without departing from the scope of the present invention. Further, it is contemplated that the various elements of the invention would be formed of materials that would be understood by those skilled in the art. For example, elements 1, 4, 6, 16 preferably are formed of known refractory materials, but element 16 could be formed of a suitable metal.

I claim:

1. in a gas rinsing stopper for use with a vessel containing molten metal, said stopper including a stopper member having therethrough an axial gas passage, a mounting fixture extending into a first end of said gas passage, a gas feed opening at a second end of said gas passage, and a gas supply line extending into said gas passage for supplying rinsing gas thereto and thereby for discharging said rinsing gas through said gas feed opening, the improvement comprising means for preventing said supplying of said rinsing gas to said gas passage from creating a reduced pressure at said first end of said gas passage and causing atmospheric air to be drawn inwardly through said first end of said gas passage and mixing with said rinsing gas within said gas passage, said preventing means comprising:

a seal member positioned within said gas passage and forming a gas tight seal separating said gas passage into a first section including said mounting fixture and a second section leading to said gas feed opening; and said gas supply line opening into said second section of said gas passage, whereby said rinsing gas is isolated from said first section of said gas passage.

2. The improvement claimed in claim 1, wherein said gas supply line opens into said second section of said gas passage at a position between said seal member and said gas feed opening.

3. The improvement claimed in claim 1, wherein said gas passage is formed with a step, and said seal member abuts said step and is fixed within said gas passage in a gas tight manner by mortar.

4. The improvement claimed in claim 1, wherein said gas supply line ends at said seal member and supplies said rinsing gas through said seal member into said second section.

5. The improvement claimed in claim 4, wherein said gas supply line extends axially through said mounting fixture to said seal member.

6. The improvement claimed in claim 4, wherein said gas supply line extends through said stopper member adjacent said mounting fixture to said seal member.

7. The improvement claimed in claim 4, further comprising a sleeve mounted within said seal member, and wherein an inner end of said gas supply line is gas tightly connected to said sleeve.

8. The improvement claimed in claim 7, wherein said gas supply line extends axially through said mounting fixture to said sleeve.

9. The improvement claimed in claim 7, wherein said gas supply line extends through said stopper member adjacent said mounting fixture to said sleeve.

* * * * *